US011346028B2

(12) United States Patent
Aveni

(10) Patent No.: US 11,346,028 B2
(45) **Date of Patent: *May 31, 2022**

(54) FOOTWEAR ARTICLE COMPRISING LINKS

(71) Applicant: NIKE, Inc., Beaverton, OR (US)

(72) Inventor: Michael A. Aveni, Lake Oswego, OR (US)

(73) Assignee: NIKE, Inc., Beaverton, OR (US)

( * ) Notice: Subject to any disclaimer, the term of this patent is extended or adjusted under 35 U.S.C. 154(b) by 1273 days.

This patent is subject to a terminal disclaimer.

(21) Appl. No.: 15/451,406

(22) Filed: Mar. 7, 2017

(65) Prior Publication Data

US 2017/0172254 A1 Jun. 22, 2017

Related U.S. Application Data

(62) Division of application No. 14/068,482, filed on Oct. 31, 2013, now Pat. No. 9,585,437, which is a division (Continued)

(51) Int. Cl.

| | |
|---|---|
| ***D04D 1/04*** | (2006.01) |
| ***A43B 1/04*** | (2022.01) |
| ***A43B 3/02*** | (2006.01) |
| ***A43B 5/06*** | (2022.01) |
| ***A43B 7/08*** | (2022.01) |

(Continued)

(52) U.S. Cl.

CPC ..... *D04D 1/04* (2013.01); *A43B 1/0027* (2013.01); *A43B 1/04* (2013.01); *A43B 3/0078* (2013.01); *A43B 3/02* (2013.01); *A43B 5/06* (2013.01); *A43B 7/08* (2013.01); *A43B 9/00* (2013.01); *A43B 23/0205* (2013.01);

(Continued)

(58) Field of Classification Search

CPC .. D04D 1/04; A43B 23/0205; A43B 23/0245; A43B 1/04; A43B 1/0027; A43B 1/14; A43B 3/0078; A43B 3/02; A43B 3/14; A43B 5/00; A43B 5/06; A43B 7/08; A43B 9/00; A43B 23/24; A43B 23/26; A43D 8/12

See application file for complete search history.

(56) References Cited

U.S. PATENT DOCUMENTS

| | | | |
|---|---|---|---|
| 261,282 | A | 7/1882 | Veddeb |
| 726,166 | A | 4/1903 | Irons |

(Continued)

FOREIGN PATENT DOCUMENTS

| | | | |
|---|---|---|---|
| EP | 383685 | A1 | 4/1994 |
| GB | 2180151 | A | 3/1987 |

(Continued)

OTHER PUBLICATIONS http://cgi.ebay.com/J-CREW-Womens-Beaded-Thongs-Sandals-Shoes-8-US-SEXY.su- b.--W0. retrieved from http://www.ebay.com/ on Oct. 15, 2007.

(Continued)

*Primary Examiner* — Ismael Izaguirre

(74) *Attorney, Agent, or Firm* — Shook Hardy & Bacon, LLP

(57) ABSTRACT

An article of footwear may be constructed of a matrix of beads. For example, by preconfiguring the row length and the number of beads in a given row, the bead matrix may be configured to form a three dimensional shape that pulls towards a centerline or is concave.

18 Claims, 12 Drawing Sheets

Related U.S. Application Data of application No. 12/266,254, filed on Nov. 6, 2008, now Pat. No. 8,602,274.

(51) Int. Cl.

| | |
|---|---|
| ***A43B 9/00*** | (2006.01) |
| ***A43B 23/26*** | (2006.01) |
| ***A43D 8/12*** | (2006.01) |
| ***A43B 1/00*** | (2006.01) |
| ***A43B 23/02*** | (2006.01) |
| ***A43B 3/00*** | (2022.01) |

(52) U.S. Cl.

CPC ..... *A43B 23/0245* (2013.01); *A43B 23/26* (2013.01); *A43D 8/12* (2013.01)

(56) References Cited

U.S. PATENT DOCUMENTS

| | | | | |
|---|---|---|---|---|
| 1,408,388 | A | 2/1922 | Noblette | |
| 1,484,178 | A | 2/1924 | Lagasse et al. | |
| 1,499,769 | A * | 7/1924 | Godefroy | A44C 11/002 245/1 |
| 1,535,646 | A * | 4/1925 | Bostock | A43B 3/0078 2/245 |
| 1,577,648 | A | 3/1926 | Mandalian | |
| 1,814,378 | A | 7/1931 | Gilbertson et al. | |
| 1,943,829 | A | 1/1934 | Koomrulan | |
| 1,992,856 | A * | 2/1935 | Blatz | D03D 1/00 112/404 |
| 1,995,989 | A | 3/1935 | Kniseley | |
| D102,946 | S | 1/1937 | Furman | |
| 2,381,860 | A | 8/1945 | Baggott | |
| 2,504,940 | A * | 4/1950 | Wallach | D03D 29/00 28/151 |
| 2,537,123 | A | 1/1951 | Dowling, Sr. | |
| 2,752,636 | A | 7/1956 | Morin | |
| 2,829,402 | A | 4/1958 | Morin | |
| 2,884,054 | A | 4/1959 | Bryant | |
| 3,464,127 | A | 9/1969 | Muncie | |
| 3,647,505 | A | 3/1972 | Bjorn | |
| 3,662,404 | A | 5/1972 | Schinker | |
| 3,676,940 | A | 7/1972 | Shively | |
| 3,718,996 | A | 3/1973 | Austin | |
| 3,875,638 | A * | 4/1975 | Burkin | H01F 41/08 140/92.7 |
| 3,949,495 | A | 4/1976 | Hollmann | |
| 3,952,351 | A | 4/1976 | Gisbert | |
| 3,977,458 | A | 8/1976 | Kuen | |
| 4,232,458 | A * | 11/1980 | Bartels | A43B 1/04 139/410 |
| 4,253,217 | A | 3/1981 | Marzocchi | |
| 4,265,032 | A | 5/1981 | Levine | |
| 4,419,836 | A | 12/1983 | Wong | |
| D281,456 | S | 11/1985 | Swedarsky | |
| 4,683,620 | A | 8/1987 | Valsecchi et al. | |
| D298,581 | S | 11/1988 | Diaz | |
| 4,801,217 | A | 1/1989 | Goldberg | |
| 4,831,749 | A | 5/1989 | Tsai | |
| 4,888,888 | A | 12/1989 | Ashton | |
| 4,893,430 | A | 1/1990 | Barfield | |
| 4,922,986 | A | 5/1990 | Leibowitz | |
| 5,096,335 | A | 3/1992 | Anderson et al. | |
| 5,139,135 | A | 8/1992 | Irwin et al. | |
| 5,215,185 | A | 6/1993 | Counter et al. | |
| 5,352,120 | A * | 10/1994 | Hambright | G09B 19/20 434/95 |
| 5,494,734 | A * | 2/1996 | Widders | D04D 7/02 428/11 |
| D375,398 | S | 11/1996 | Cetrangelo | |
| D384,205 | S | 9/1997 | Fink | |
| 5,768,802 | A | 6/1998 | Bramani | |
| D395,741 | S | 7/1998 | Hatfield et al. | |
| 5,964,340 | A | 10/1999 | Dolan et al. | |
| D417,788 | S | 12/1999 | Gray | |
| D420,507 | S | 2/2000 | Fillio | |
| 6,401,364 | B1 | 6/2002 | Burt | |
| 6,589,891 | B1 * | 7/2003 | Rast | A41D 13/0158 442/1 |
| 6,763,611 | B1 | 7/2004 | Fusco | |
| D494,737 | S | 8/2004 | Schaefer | |
| 6,871,420 | B2 | 3/2005 | Shikhashvili | |
| D505,213 | S | 5/2005 | Kumar | |
| 6,986,269 | B2 | 1/2006 | Dua | |
| 6,991,141 | B2 * | 1/2006 | Ciko | A44C 11/002 223/48 |
| D517,297 | S | 3/2006 | Jones | |
| 7,031,527 | B2 | 4/2006 | Ishikawa et al. | |
| D531,795 | S | 11/2006 | Gonzalez | |
| D533,983 | S | 12/2006 | Thornton | |
| 7,240,517 | B2 | 7/2007 | Barak | |
| 7,909,066 | B2 * | 3/2011 | Wada | D03D 25/00 139/1 R |
| 7,941,946 | B2 | 5/2011 | Clancy et al. | |
| 7,945,343 | B2 | 5/2011 | Jones et al. | |
| 8,151,488 | B2 | 4/2012 | Aveni | |
| 8,295,962 | B2 | 10/2012 | Jones et al. | |
| 8,601,720 | B2 | 12/2013 | Aveni | |
| 8,602,274 | B2 | 12/2013 | Aveni | |
| 8,707,493 | B2 | 4/2014 | Aveni | |
| 9,480,295 | B2 | 11/2016 | Aveni | |
| 2002/0012784 | A1 | 1/2002 | Norton et al. | |
| 2004/0019950 | A1 * | 2/2004 | Rast | A41D 13/0158 2/77 |
| 2004/0134229 | A1 * | 7/2004 | Oliver | A41D 31/0005 63/37 |
| 2006/0059715 | A1 | 3/2006 | Aveni | |
| 2006/0107550 | A1 | 5/2006 | Caminiti | |
| 2006/0117600 | A1 | 6/2006 | Greene | |
| 2006/0134351 | A1 * | 6/2006 | Greene | A43B 1/14 428/12 |
| 2006/0213936 | A1 | 9/2006 | Ciko et al. | |
| 2008/0010867 | A1 | 1/2008 | Davis | |
| 2008/0147219 | A1 * | 6/2008 | Jones | A43B 1/0054 700/95 |
| 2009/0019648 | A1 | 1/2009 | Jones et al. | |
| 2010/0107346 | A1 * | 5/2010 | Aveni | A43B 1/0027 12/146 R |
| 2010/0107443 | A1 * | 5/2010 | Aveni | A41D 19/01547 36/84 |
| 2010/0305909 | A1 * | 12/2010 | Wolper | G06T 17/00 703/1 |
| 2012/0222195 | A1 | 9/2012 | Aveni | |
| 2012/0227283 | A1 | 9/2012 | Aveni | |
| 2014/0123408 | A1 | 5/2014 | Aveni | |
| 2014/0157628 | A1 | 6/2014 | Aveni | |

FOREIGN PATENT DOCUMENTS

| | | |
|---|---|---|
| GB | 2430409 A | 3/2007 |
| JP | 61000301 A | 1/1986 |
| JP | 2004073585 A | 3/2004 |

OTHER PUBLICATIONS http://cgi.ebay.com/Antique-Fully-Beaded-Slippers-Beadwork-Shoes-Oriental.- sub.--W0QQite. retrieved from http://www.ebay.com/ on Oct. 15, 2007.

http://cgi.ebay.com/Womens-bead-beaded-EARTH-SHOE-sandals-shoes-size-9-M.s- ub.--W0Q. retrieved from http://www.ebay.com/ on Oct. 15, 2007.

http://web.archive.org/web/20070630111741/http://www.abetterbead.com/multi- -hole-cart.html dated Jun. 30, 2007 retrieved from web.archive.org on Aug. 27, 2011.

* cited by examiner

FOOTWEAR ARTICLE COMPRISING LINKS

CROSS-REFERENCE TO RELATED APPLICATIONS

This application is a divisional of U.S. patent application Ser. No. 14/068,482 (filed on Oct. 31, 2013), which is a divisional of U.S. patent application Ser. No. 12/266,254 (filed on Nov. 6, 2008), each of which is incorporated herein by reference in its entirety.

BACKGROUND

The present invention relates to a method of making articles, and in particular to a method of making articles comprising links.

Methods of making articles with links have been previously proposed. Greene (U.S. patent application publication number 2006/0134351) teaches a material formed of multiple links and a method of forming the same. Greene teaches a frame having at least one elongate member formed of a first polymer. At least one link is formed of a second polymer, with a portion of each link co-molded about a portion of the at least one elongate member.

Greene teaches a method of forming elongate members and links using molding techniques. During a first step, a mold is used to form a set of elongate members that comprise a frame. During a second step, a second mold is applied to the frame in order to form links around the elongate members of the frame.

Rast (U.S. Pat. No. 6,589,891) teaches an abrasion resistant conformal beaded-matrix for use in safety garments. Rast teaches a material where abrasion-resistant, low-friction beads are held within a matrix of high-tensile strength, abrasion-resistant cords. Rast teaches that individual beads can be integrated, or assembled within the cord matrix, or molded onto a cord matrix.

The related art lacks provisions for facilitating assembly of a linked article.

SUMMARY

A method of making an article comprising links is disclosed. In one aspect, the invention provides a method of making an article, comprising the steps of: providing a link pattern, the link pattern comprising a plurality of link indicia that correspond to a plurality of links; associating each link from the plurality of links with a link indicia from the plurality of link indicia; threading a plurality of threads through the plurality of links to form a link matrix; and associating the link matrix with a portion of the article.

In another aspect, the link pattern includes a plurality of rows of link indicia.

In another aspect, each row is associated with a thread from the plurality of threads.

In another aspect, at least one link indicia is associated with two adjacent rows.

In another aspect, the plurality of links includes at least one double link that is configured to receive two threads.

In another aspect, the plurality of links includes at least one single link that is configured to receive a single thread.

In another aspect, the invention provides a method of making an article, comprising the steps of: providing a link pattern, the link pattern comprising a plurality of link indicia that correspond to a plurality of links; associating each link from the plurality of links with a link indicia from the plurality of link indicia; threading a plurality of threads through the plurality of links to form a link matrix; tightening the plurality of threads in a manner that changes the geometry of a first portion of the link matrix; and associating the link matrix with a curved portion of the article.

In another aspect, the link pattern includes at least two adjacent link indicia separated by a gap.

In another aspect, the gap corresponds to a curved portion of the link matrix.

In another aspect, the article is an article of footwear.

In another aspect, the link matrix is associated with a tongue of the article of footwear.

In another aspect, the link matrix is associated with an upper of the article of footwear.

In another aspect, the geometry of the link matrix changes from a substantially flat geometry to a curved geometry.

In another aspect, the invention provides a method of making an article, comprising the steps of: creating a link pattern according to a pre-selected portion of the article, the link pattern comprising a plurality of link indicia that correspond to a plurality of links; associating each link from the plurality of links with a link indicia from the plurality of link indicia; threading a plurality of threads through the plurality of links to form a link matrix; and associating the link matrix with the pre-selected portion.

In another aspect, the step of creating a link pattern includes a step of generating a link pattern using a computer.

In another aspect, the step of threading the plurality of threads through the plurality of links is followed by a step of tying ends of the plurality of threads.

In another aspect, the link pattern is two-dimensional.

In another aspect, the step of forming the link matrix includes forming a two-dimensional link matrix.

In another aspect, the step of forming a two-dimensional link matrix is followed by a step of moving at least one link towards a center of the link matrix.

In another aspect, the curvature of the link matrix changes as the at least one link is moved.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
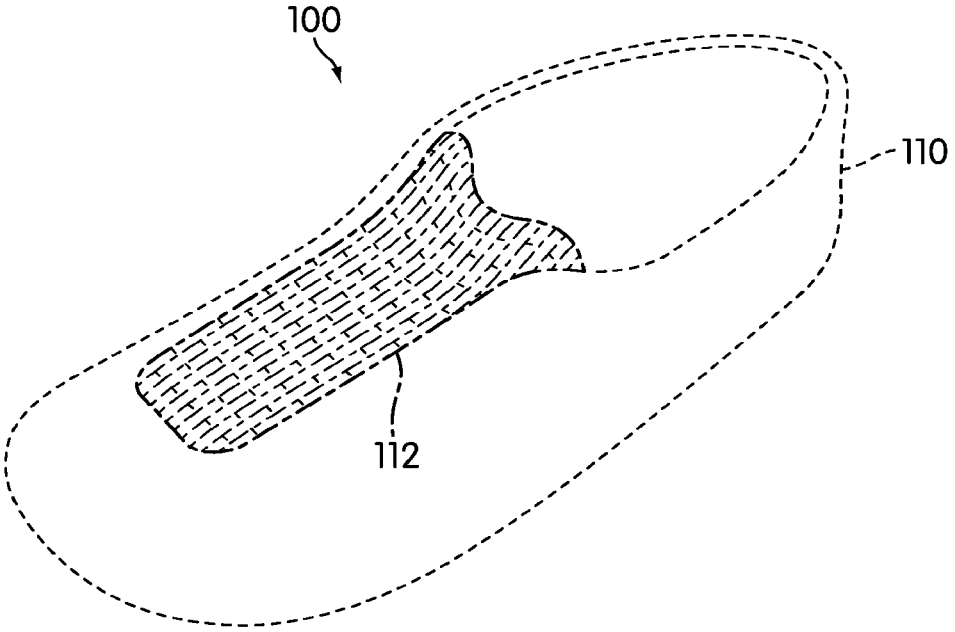
FIG. 1 is a schematic view of an embodiment of an article.

FIG. 1 is a schematic view of an embodiment of article 100 that is configured to be worn. In this exemplary embodiment, article 100 is an article of footwear. However, it should be understood that the principles taught throughout this detailed description may be applied to additional articles as well. Generally, these principles could be applied to any article that can be worn. In some embodiments, the article may include one or more articulated portions that are configured to move. In other cases, the article may be configured to conform to portions of a wearer in a three-dimensional manner. Examples of articles that are configured to be worn include, but are not limited to, footwear, gloves, shirts, pants, socks, scarves, hats, jackets, as well as other articles. Other examples of articles include, but are not limited to, shin guards, knee pads, elbow pads, shoulder pads, as well as any other type of protective equipment. Additionally, in some embodiments, the article could be another type of article that is not configured to be worn, including, but not limited to, bags, purses, backpacks, as well as other articles that may not be worn.

In one exemplary embodiment, article 100 may be a slip-on type of article of footwear that does not require lacing. However, in other embodiments, article 100 could be any type of footwear, including, but not limited to, a running shoe, a basketball shoe, a high heel shoe, a boot, a high top shoe, a low top shoe, as well as other types of footwear. Additionally, while a single article is shown in the current embodiment, the same principles taught in this detailed description could be applied to a second, complementary article of footwear.

In different embodiments, article 100 can comprise different portions. In this embodiment, article 100 includes upper portion 110. Furthermore, upper portion 110 includes tongue portion 112. In some cases, tongue portion 112 may be a distinct portion of article 100. For example, in one embodiment, tongue portion 112 may be assembled and then joined with upper portion 110.

In some embodiments, article 100 could further be associated with a sole system. In some cases, a sole system for article 100 could include an outsole. In other cases, the sole system could include a midsole. In still other cases, the sole system could include an insole. In an exemplary embodiment, article 100 may not include a sole system. For example, in one embodiment, upper portion 110 may be provided with a bottom surface that is configured to provide support to, and protect, a bottom surface of a foot of a user.

Referring to FIG. 1, portions of article 100 may be made of a plurality of links. For example, in this embodiment tongue portion 112 is made from a plurality of links. In some cases, additional portions of article 100, including portions of upper portion 110 or a sole of article 100 could also be made of a plurality of links. The term "link" as used throughout this detailed description and in the claims, refers to any object that includes a hole for receiving some kind of threading material. In some cases, a link may be a bead. However, the term link is not intended to be limited to an object of any particular size, shape, or material composition. Additionally, the term link may further include various types of links that are molded onto threaded materials during manufacturing and which are commonly known in the art.

In some cases, different portions of article 100 can be associated with a link matrix. The term "link matrix", as used throughout this detailed description and in the claims, refers to any substantially continuous arrangement of links into a fabric-like matrix. In some embodiments, a link matrix may comprise a plurality of links that are connected using a threading material. Examples of linked articles are disclosed in Aveni, U.S. Pat. No. 8,151,488, issued Apr. 10, 2012, and entitled "Linked Articles," the entire disclosure of which is incorporated herein by reference; this co-owned application is hereby referred to as the "linked article case."

FIGS. 2-15 are intended to illustrate an embodiment of a method of making an article comprising links. For purposes of clarity, FIGS. 2-15 illustrate a method of making a tongue portion of an article of footwear made of links. However, it should be understood that this method could also be used for making any other portion of an article. For example, in embodiments where the linked article is an article of footwear, this method could be used to make the upper, the sole, as well as any other portions of the article. Furthermore, this method could be used to make individual portions of an article that could later be assembled together to form a completed article.

Figure 2:
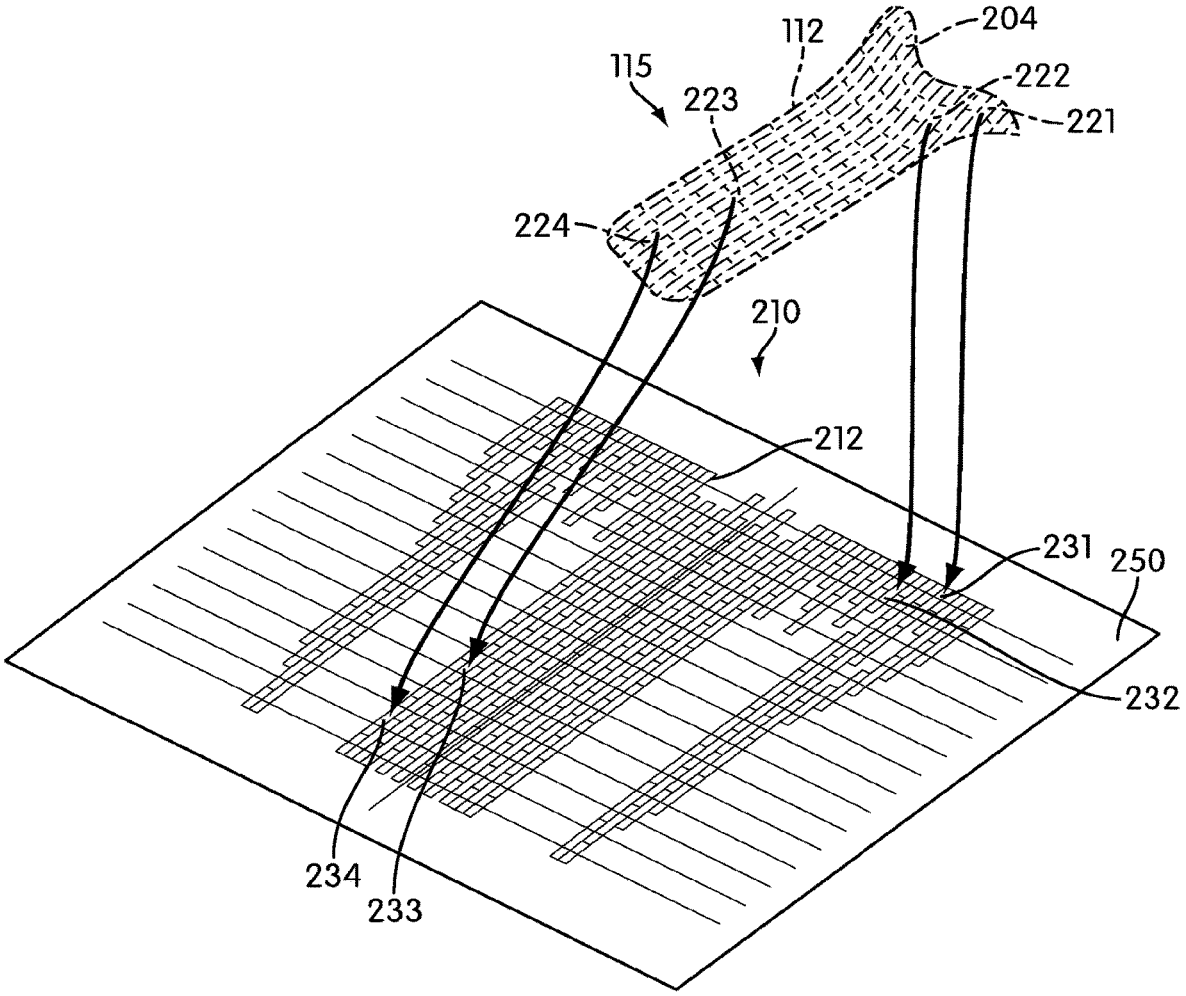
FIG. 2 is a schematic view of an embodiment of a link matrix for a tongue portion of an article with an associated link pattern.

Referring to FIG. 2, tongue portion 112 comprises link matrix 115. In particular, link matrix 115 may comprise plurality of links 204. In some cases, plurality of links 204 can be arranged in rows that extend in a lateral or widthwise direction of tongue portion 112. In other cases, plurality of links 204 can be arranged in vertical columns within link matrix 115. In still other cases, plurality of links 204 can be arranged in any other manner.

A method of making a linked article can include provisions for determining a link pattern that can be used to assemble a particular link matrix. The term "link pattern" as used throughout this detailed description and in the claims refers to any arrangement of two or more link indicia that can be used for associating two or more links together. In particular, once a portion of a linked article has been designed in three dimensions, a manufacturer may perform one or more steps for generating a two-dimensional link pattern that can be used to easily reconstruct the link matrix. For example, in some cases, a link pattern can comprise link indicia arranged in several rows to indicate the relative location of each link in a link matrix with respect to adjacent links and relative to individual strands of a threading material.

In some cases, a link pattern can be manually created. For example, a link pattern can be hand drawn by a designer according to a predetermined link matrix associated with a linked article. In other cases, a link pattern can be determined automatically using a machine of some kind. For example, in one embodiment, a computer algorithm can be used to generate a two-dimensional link pattern that corresponds to a link matrix of a linked article.

Referring to FIG. 2, tongue portion 112 may be associated with link pattern 210. Link pattern 210 may be a two-dimensional representation of tongue portion 112. In some cases, link pattern 210 may comprise plurality of link indicia 212 that correspond to links of tongue portion 112. In other words, plurality of links 204 of tongue portion 112 may be in a one-to-one correspondence with plurality of link indicia 212. For example, first link 221 may correspond to first link indicia 231. Likewise, second link 222 may correspond to second link indicia 232. Also, third link 223 may correspond to third link indicia 233. Finally, fourth link 224 may correspond to fourth link indicia 234. It should be understood that each of the remaining links of link matrix 115 is also associated with a unique link indicia of link pattern 210.

For consistency and convenience, directional adjectives are employed throughout this detailed description corresponding to the illustrated embodiments. The term "longitudinal" as used throughout this detailed description and in the claims refers to a direction extending a length of an article. Also, the term "lateral" as used throughout this detailed description and in the claims refers to a direction extending a width of an article. The terms "medial" and "lateral" are used throughout this detailed description and in the claims with respect to a longitudinal centerline through a link pattern. The medial being toward the centerline and the lateral being toward the outer edge or away from the centerline.

Generally, a link pattern can be constructed in any manner. In some cases, the link pattern can be applied to a sheet. In embodiments using a sheet, the sheet can be made of any material including, but not limited to, paper, fabric, plastic, metal, wood, as well as any other type of material. Furthermore, the link pattern can be applied to a sheet using any known techniques including, but not limited to, printing, etching, drawing, as well as other techniques. In this embodiment, link pattern 210 may be printed onto sheet 250. In an exemplary embodiment, sheet 250 may be a plastic sheet.

In some embodiments, a link pattern can include a plurality of link indicia arranged in horizontal rows. Generally, the number of rows comprising a link pattern can vary. In some cases, a link pattern can include only a single row of link indicia. In other cases, a link pattern can include two or more rows of link indicia. For example, in an exemplary embodiment, link pattern 210 may comprise nineteen rows of link indicia.

Figure 3:
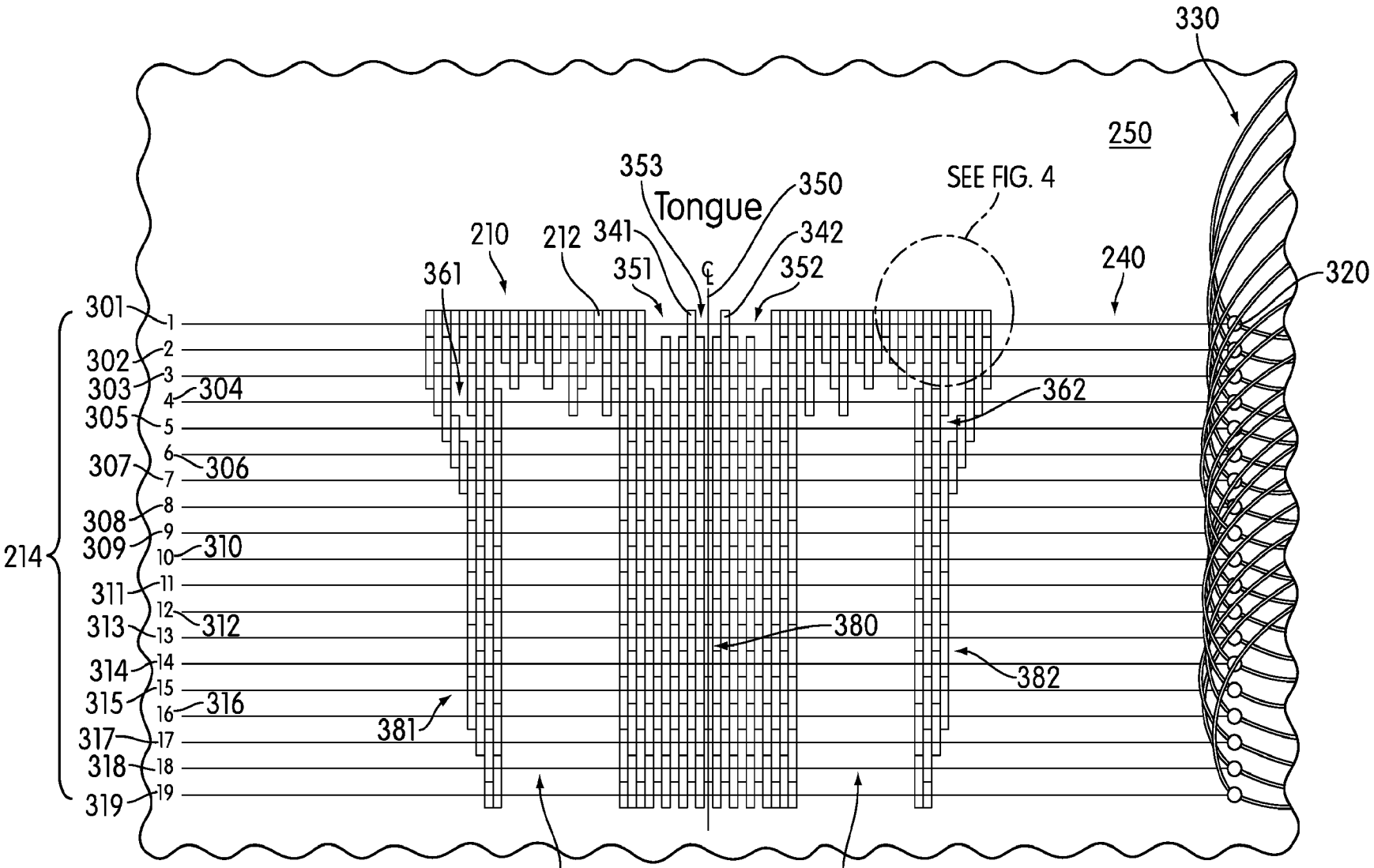
FIG. 3 is a schematic view of an embodiment of a thread set attached to a sheet with a link pattern.

Referring to FIG. 3, link pattern 210 comprises rows 214. Rows 214 include first row 301, second row 302, third row 303, fourth row 304, fifth row 305, sixth row 306, seventh row 307, eighth row 308, ninth row 309, tenth row 310, eleventh row 311, twelfth row 312, thirteenth row 313, fourteenth row 314, fifteenth row 315, sixteenth row 316, seventeenth row 317, eighteenth row 318 and nineteenth row 319. With this configuration, each link indicia of link pattern 210 may be associated with at least one row. Furthermore, this arrangement facilitates construction of a link matrix by allowing assembly of the link matrix in a row by row manner.

Each row of link pattern 210 may be configured to receive a single thread during assembly of a link matrix. In some cases, link pattern 210 can include thread indicia that are configured to visually indicate the location of a set of threads that may be inserted through plurality of links 204. In one embodiment, link pattern 210 can include thread indicia set 240. In some cases, thread indicia set 240 may be in a one-to-one correspondence with rows 214. In other words, each row of rows 214 is associated with a thread indicia of thread indicia set 240. In other embodiments, each row of link indicia may be associated with more than one thread indicia of thread indicia set 240. In still other embodiments, a single thread indicia may be associated with multiple rows of link indicia.

A link pattern can include provisions for indicating the locations of different types of links. In some cases, for example, two different types of link indicia can be used to indicate the use of two different types of links. In still other cases, three or more different types of link indicia can be used to indicate the use of three or more different types of links. For example, in one embodiment, different sized link indicia can be used to indicate the use of different sized links. Also, in other cases, different colored link indicia can be used to indicate different colored links.

In different embodiments, a plurality of link indicia can indicate different sized links. In some cases, the plurality of link indicia can indicate an arrangement of large and small links. For example, in some cases, the plurality of link indicia can indicate an arrangement of alternating large and small links. In other cases, however, the plurality of link indicia can indicate only links of a substantially similar size. Furthermore, a plurality of link indicia can comprise different shapes. Examples of different link indicia shapes include rectangular shapes, circular shapes, elliptic shapes, regular shapes, irregular shapes as well as other types of shapes.

Figure 4:
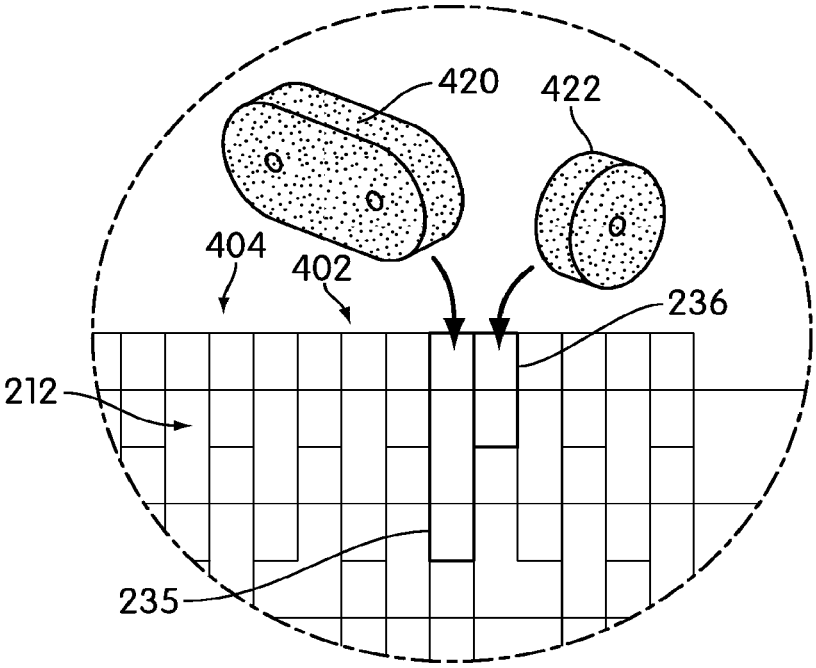
FIG. 4 is an enlarged view of an embodiment of a portion of a link pattern with a first link indicia set and a second link indicia set.

Referring to FIG. 4, plurality of link indicia 212 may comprise first link indicia set 402 and second link indicia set 404. In some embodiments, first link indicia set 402 may comprise link indicia having a rectangular shape. Likewise, second link indicia set 404 may comprise link indicia having a rectangular shape. Furthermore, the link indicia of first link indicia set 402 may have a longer length than the link indicia of second link indicia set 404. With this arrangement, first link indicia set 402 and second link indicia set 404 can be used to indicate the relative locations of different sized links.

In this embodiment, first link indicia set 402 may comprise link indicia that are associated with double links. The term "double link" as used throughout this detailed description and in the claims refers to a link that is configured to receive two threads. In other words, a double link spans two rows of a link matrix. In this exemplary embodiment, first link indicia set 402 may span two rows of link pattern 210. For example, in this embodiment, fifth link indicia 235 of first link indicia set 402 is used to indicate the location of double link 420.

Second link indicia set 404 may comprise link indicia that are associated with single links. The term "single link" as used throughout this detailed description and in the claims refers to a link that is configured to receive a single thread. In other words, a single link spans a single row of a link matrix. In this exemplary embodiment, second link indicia set 404 may span a single row of link pattern 210. For example, in this embodiment, sixth link indicia 236 of second link indicia set 404 is used to indicate the location of single link 422.

In order to begin assembling a link matrix for an article comprising links, one or more threads may be associated with a two-dimensional link pattern. Generally, one or more threads may be temporarily attached to a sheet including a link pattern in any manner. In some cases, one or more threads may be attached to a sheet using a fastener of some kind. In still other cases, a temporary adhesive may be used.

Referring to FIG. 3, thread set 330 may be temporarily attached to sheet 250 using fastener set 320. In different embodiments, fastener set 320 can be disposed in various portions of sheet 250. In one embodiment, fastener set 320 may be disposed on an edge of sheet 250 that is associated with ends of thread indicia set 240. With this arrangement, thread set 330 may be drawn across sheet 250 in a manner that allows thread set 330 to be disposed over thread indicia set 240.

Generally, threads used to make a linked article can comprise a threading material. A threading material may be formed from any generally one-dimensional material. As utilized with respect to the present invention, the term "one-dimensional material" or variants thereof is intended to encompass generally elongate materials exhibiting a length that is substantially greater than a width and a thickness. Accordingly, suitable materials for threading materials include various filaments and yarns, for example. Filaments may be formed from a plurality of synthetic materials such as rayon, nylon, polyester, and polyacrylic, with silk being the primary, naturally-occurring exception. In addition, various engineering fibers, such as aramid fibers, para-aramid fibers, and carbon fibers, may be utilized. Yarns may be formed from at least one filament or a plurality of fibers. Whereas filaments have an indefinite length, fibers have a relatively short length and generally go through spinning or twisting processes to produce a yarn of suitable length. With regarding to yarns formed from filaments, these yarns may be formed from a single filament or a plurality of individual filaments grouped together. Yarns may also include separate filaments formed from different materials, or yarns may include filaments that are each formed from two or more different materials. Similar concepts also apply to yarns formed from fibers. Accordingly, filaments and yarns may have a variety of configurations exhibiting a length that is substantially greater than a width and a thickness. In addition to filaments and yarns, other one-dimensional materials may be utilized for threading material. Although one-dimensional materials will often have a cross-section where width and thickness are substantially equal (e.g., a round or square cross-section), some one-dimensional materials may have a width that is greater than a thickness (e.g., a rectangular cross-section). Despite the greater width, a material may be considered one-dimensional if a length of the material is substantially greater than a width and a thickness of the material.

A link pattern can be configured with different shapes. In some cases, a link pattern can have a substantially symmetric shape. In other cases, a link pattern can have a substantially asymmetric shape. In one embodiment, link pattern 210 is configured with a substantially symmetric shape with respect to centerline 350 of link pattern 210. With this arrangement, link pattern 210 may be used to make a tongue for an article of footwear that has a substantially symmetric shape.

Generally, gaps in a link pattern can be associated with varying shapes. In some embodiments, a plurality of gaps may include triangular shaped gaps. In other embodiments, a plurality of gaps may include substantially rectangular shaped gaps. In still other embodiments, a plurality of gaps may include irregularly shaped gaps. In one embodiment, a plurality of gaps may include a combination of gaps of varying shapes.

Gaps in a link pattern can also be associated with varying sizes. In particular, the length of one or more gaps may vary, where the length is measured according to the number of rows that are spanned by the gaps. In some cases, a gap can extend through a single row. In other cases, a gap can extend through multiple rows. Also, the width of the gaps may vary, where the width is measured according to the number of links that can fit widthwise within a particular row of the gap. In some cases, a gap can have a size corresponding to the size of a single link. In other cases, a gap can have a size corresponding to the size of a double link. In still other cases, a gap can have a size corresponding to the size of multiple links.

Referring to FIG. 3, link pattern 210 is associated with a plurality of gaps. In some embodiments, link pattern 210 can include first gap 351 and second gap 352 that extend from first row 301 to third row 303. Furthermore, first gap 351 and second gap 352 have widths that vary between one link width and five link widths. In one exemplary embodiment, first gap 351 and second gap 352 have a substantially similar shape. In particular, first gap 351 has a shape that is a mirror image of second gap 352. In other embodiments, however, first gap 351 and second gap 352 can have substantially different shapes.

In one embodiment, link pattern 210 further comprises third gap 353 that is disposed between first central link indicia 341 and second central link indicia 342. Third gap 353 extends from first row 301 to second row 302. Furthermore, third gap 353 has a width of three links within first row 301 and a width of one link within second row 302. With this arrangement, third gap 353 may be substantially symmetric with respect to centerline 350.

In some embodiments, link pattern 210 also includes first peripheral gap 361 and second peripheral gap 362. First peripheral gap 361 and second peripheral gap 362 both extend from second row 302 to sixth row 306. Additionally, the widths of first peripheral gap 361 and second peripheral gap 362 are between one and two link widths. In some cases, first peripheral gap 361 has a shape that is a mirror image of second peripheral gap 362.

In some embodiments, link pattern 210 can include first wide gap 371 and second wide gap 372. First wide gap 371 may extend from third row 303 to nineteenth row 319. Furthermore, first wide gap 371 may have a width of approximately fourteen link widths. Second wide gap 372 may have a substantially similar size and shape to first wide gap 371. In particular, second wide gap 372 may extend from third row 303 to nineteenth row 319. Also, second wide gap 372 may have a width of approximately fourteen link widths. With this arrangement, first wide gap 371 may separate first lateral portion 381 of link pattern 210 from central portion 380 of link pattern 210. Likewise, second wide gap 372 may separate second lateral portion 382 of ink pattern 210 from central portion 380 of link pattern 210.

Figure 5:
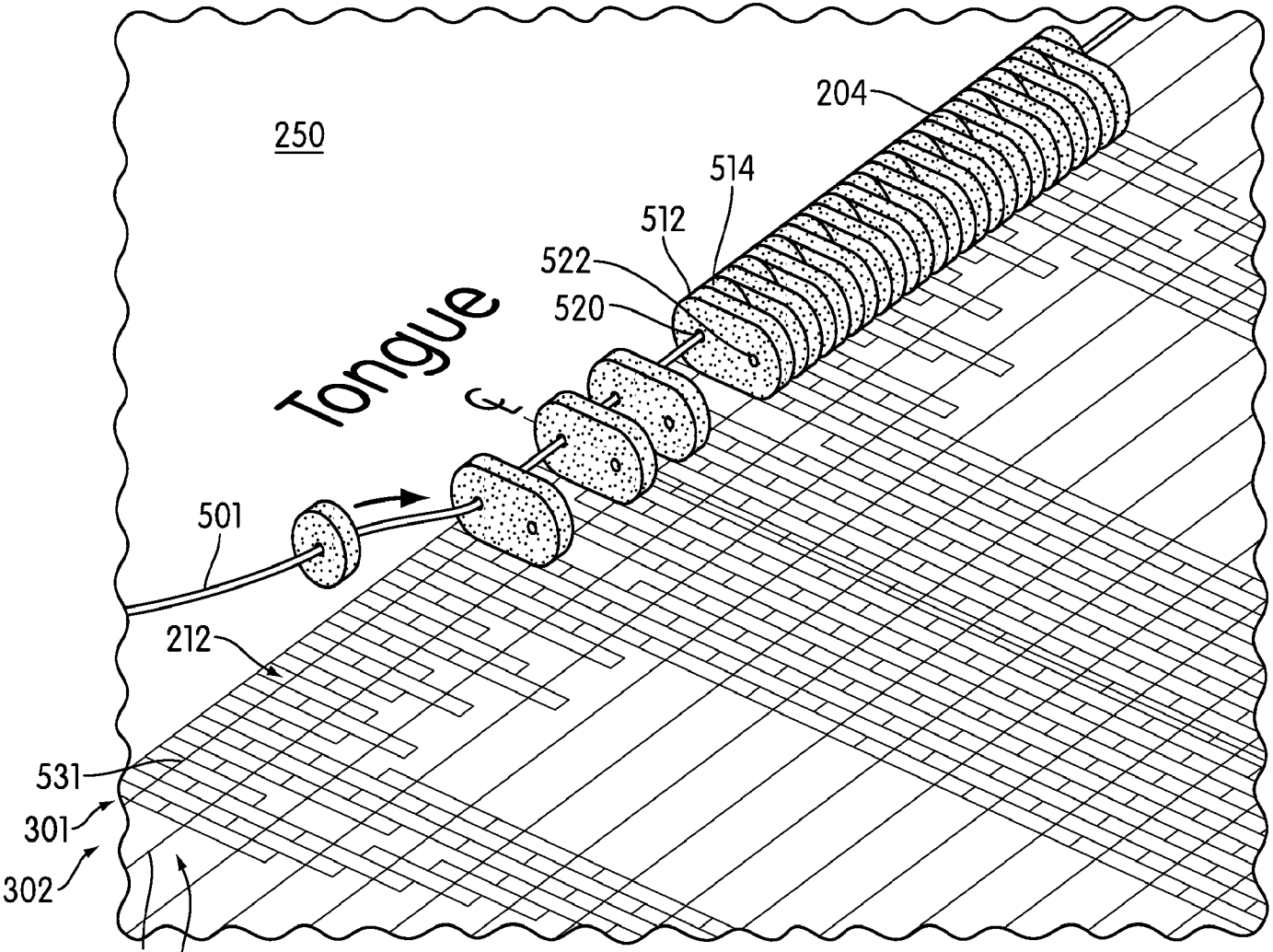
FIG. 5 is an isometric view of an embodiment of a plurality of links threaded onto a first thread that corresponds to a first thread indicia in a first row of a link matrix.
Figure 6:
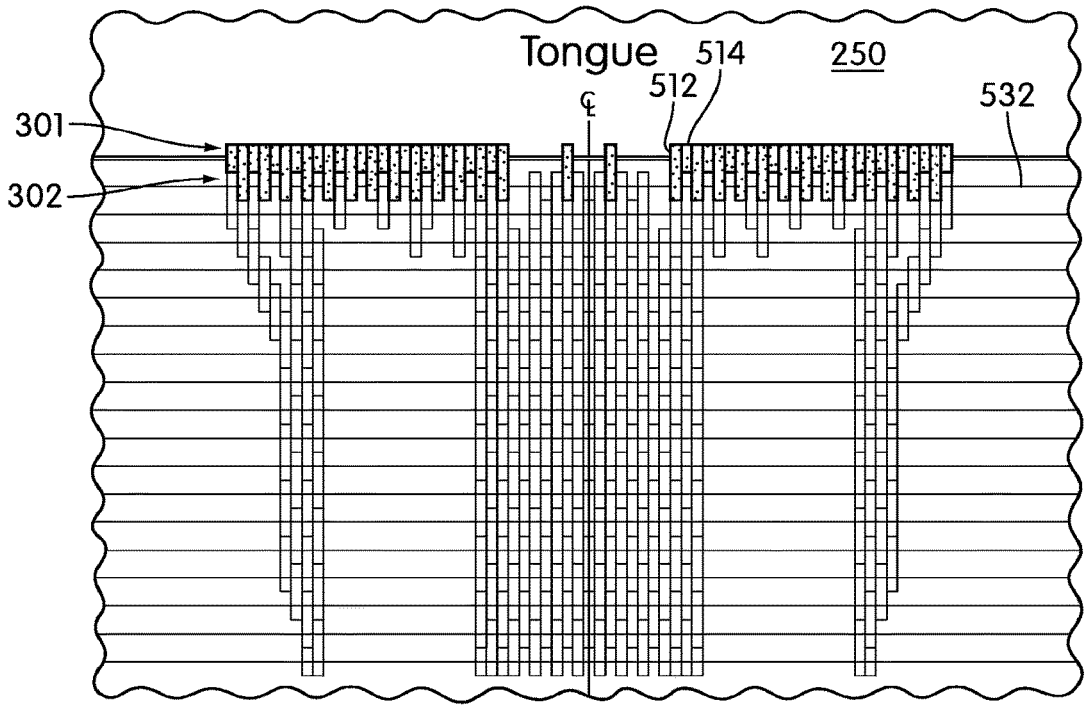
FIG. 6 is a schematic view of an embodiment of a plurality of double links and single links that are threaded onto a first thread that is aligned with a first thread indicia in a first row.
Figure 7:
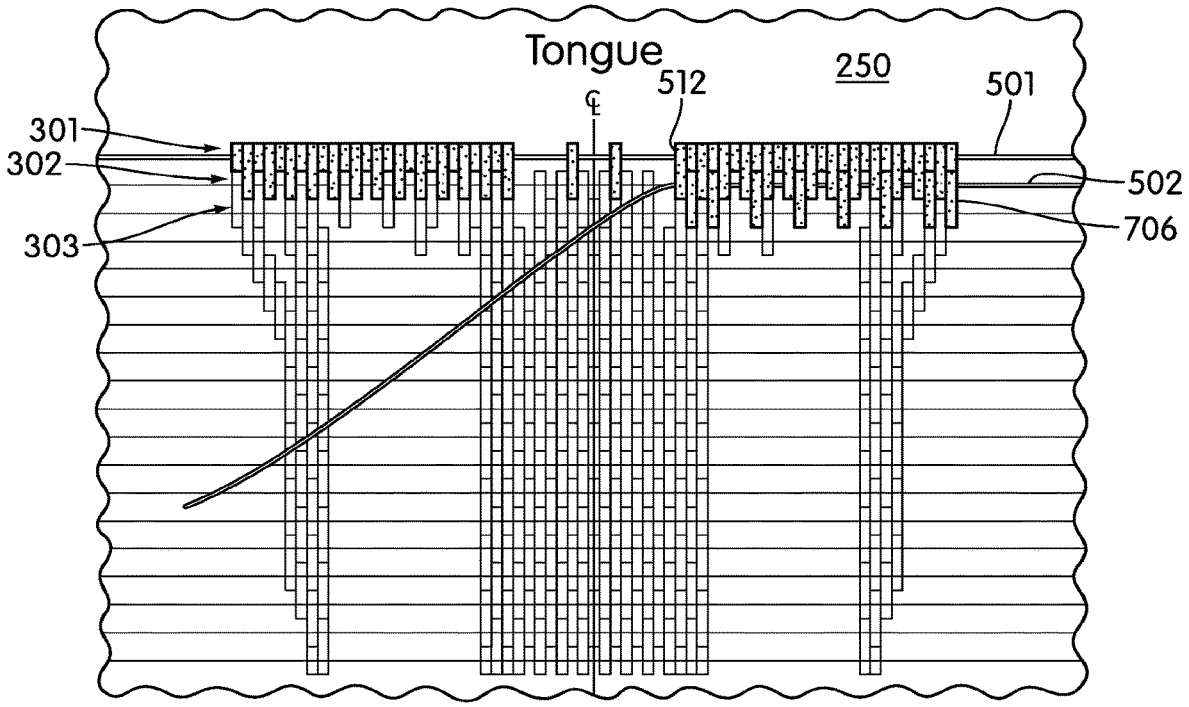
FIG. 7 is a schematic view of an embodiment of a plurality of double links and single links that are threaded onto a second thread that is aligned with a second thread indicia in a second row.
Figure 8:
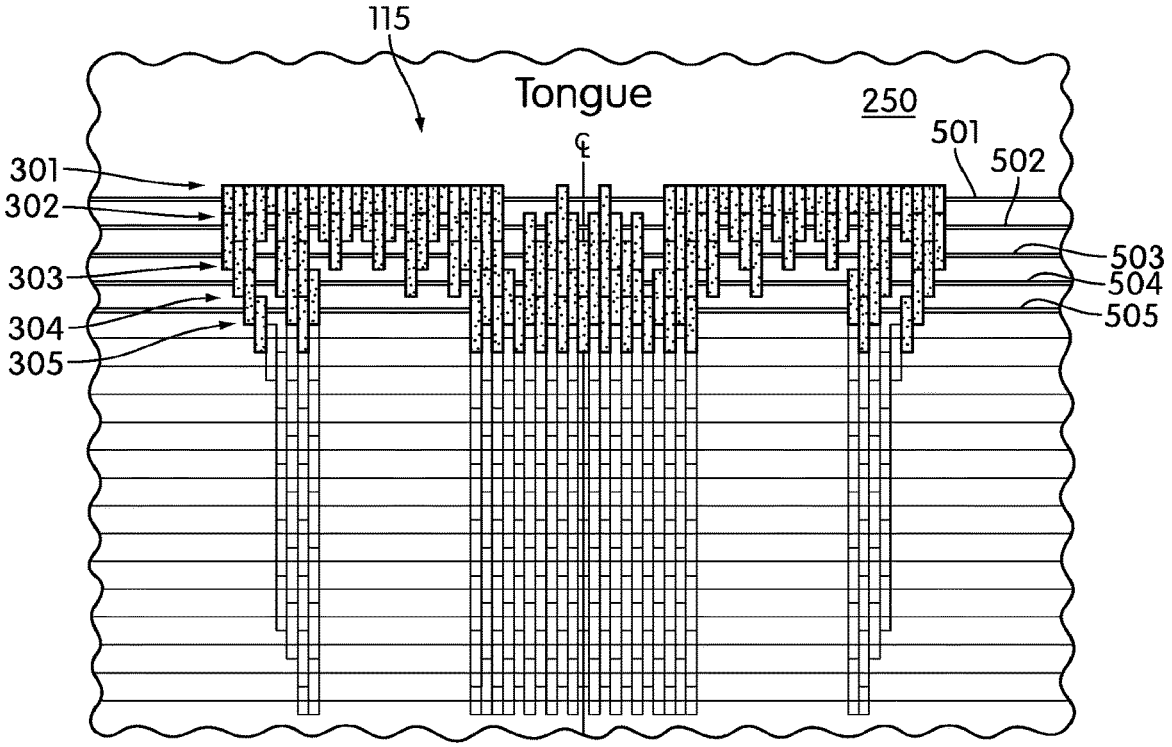
FIG. 8 is a schematic view of an embodiment of an assembly of five rows of a link matrix.
Figure 9:
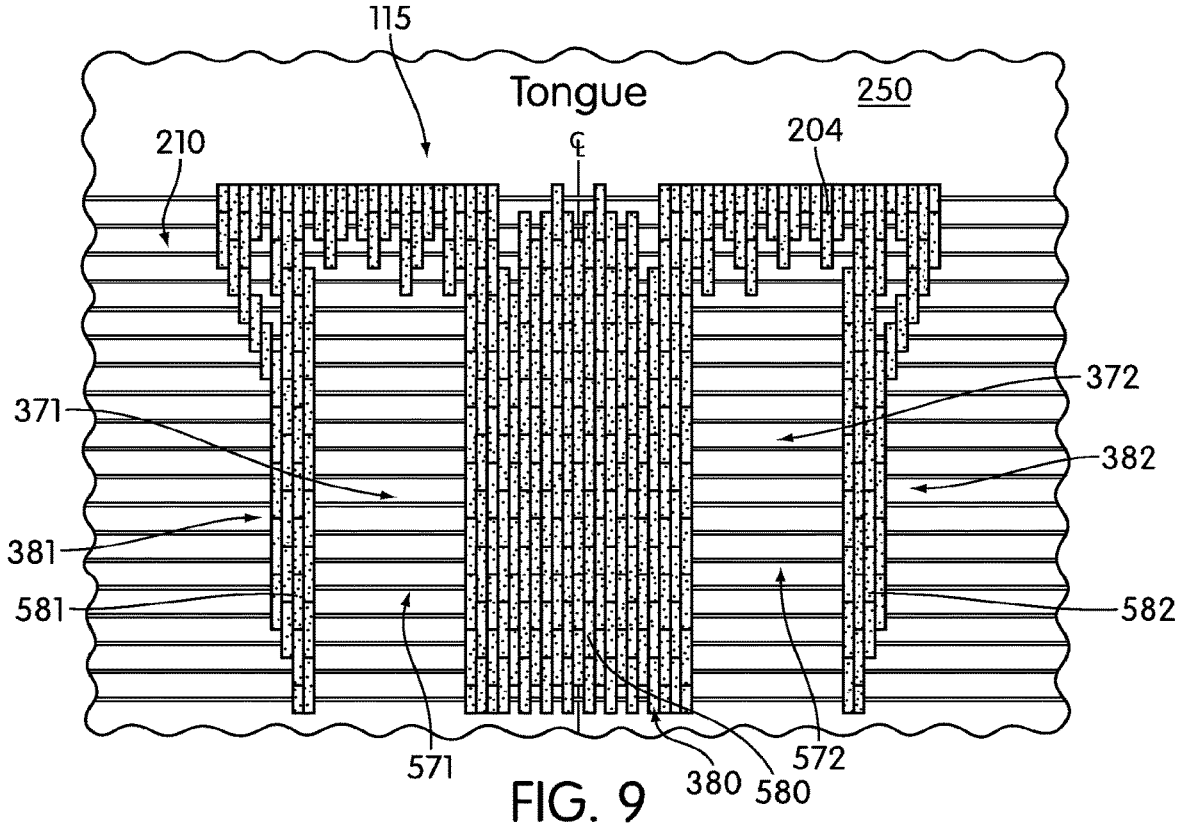
FIG. 9 is a schematic view of an embodiment of an assembly of all rows of a link matrix.

FIGS. 5 through 9 illustrate steps for assembling a link matrix using a link pattern. Referring to FIGS. 5 through 9, in some cases, a link matrix may be assembled one row at a time. For purposes of illustration, FIGS. 5 and 6 illustrate the assembly of a first row of links. Likewise, FIGS. 7 and 8 illustrate the assembly of a second row of links and a fifth row of links, respectively. Finally, FIG. 9 illustrates a complete assembly of each of the nineteen rows of the link matrix of the current embodiment.

Referring to FIG. 5, a set of plurality of links 204 have been threaded onto first thread 501 that corresponds to first thread indicia 531 of thread indicia set 240. Each of plurality of links 204 is arranged in a manner that corresponds to plurality of link indicia 212. In this exemplary embodiment, first set of double links 512 are threaded in an alternating manner with first set of single links 514. In particular, first thread 501 may be threaded through first set of single links 514 disposed within first row 301. Also, first thread 501 may be threaded through first set of double links 512 at first hole set 520 that is associated with first row 301.

As seen in FIGS. 5 and 6, first set of double links 512 may extend between first row 301 and second row 302. In particular, second hole set 522 of first set of double links 512 may be aligned with second thread indicia 532 of second row 302. This arrangement allows a second thread to be inserted through second hole set 522 in order to provide a connection between links of adjacent rows. In some embodiments, double links may be used to connect every set of adjacent rows in a link matrix. In other embodiments, double links may be used to connect only some adjacent rows in a link matrix.

Referring to FIG. 7, a set of plurality of links 204 has been threaded over second thread 502. In particular, a plurality of double links and single links have been associated with a plurality of link indicia disposed in second row 302. For example, second thread 502 has been inserted through first set of double links 512 that extends between first row 301 and second row 302. Additionally, second thread 502 has been inserted through second set of double links 706 that extends between second row 302 and third row 303. With this arrangement, double links may be used to connect multiple adjacent rows of a completed linked article.

Referring to FIG. 8, five rows of link matrix 115 have been assembled. In some cases, third row 303, fourth row 304 and fifth row 305 may be assembled in a similar manner to the assembly of first row 301 and second row 302. In particular, third row 303, fourth row 304 and fifth row 305 may be assembled by threading a set of links through third thread 503, fourth thread 504 and fifth thread 505. Each set of links may be aligned with a set of link indicia disposed within each corresponding row.

Referring to FIG. 9, all nineteen rows of link matrix 115 have been assembled. In some cases, the remaining rows have all been assembled in a similar manner to the first five rows. With all nineteen rows of link matrix 115 assembled, plurality of links 204 are arranged to correspond to plurality of link indicia 212, not visible in this Figure.

In this exemplary embodiment, link matrix 115 includes first wide gap 571 and second wide gap 572 that correspond to first wide gap 371 and second wide gap 372, respectively, of link pattern 210. As previously discussed, first wide gap 371 separates first lateral portion 381 of link pattern 210 from central portion 380 of link pattern 210. Likewise, first wide gap 571 of link matrix 115 separates first lateral portion 581 of link matrix 115 from central portion 580 of link matrix 115. Also, in a substantially similar manner to second wide gap 372 in link pattern 210, second wide gap 572 separates second lateral portion 582 of link matrix 115 from central portion 580 of link matrix 115. This arrangement allows links disposed within first lateral portion 581 and second lateral portion 582 to move inwardly towards central portion 580 during later steps of assembly.

In order to proceed with the assembly of link matrix 115, thread set 330 may be removed from sheet 250. In some cases, fasteners used to secure thread set 330 to sheet 250 may be removed. In embodiments where thread set 330 is secured in another manner, thread set 330 can be cut away from sheet 250.

Referring to FIGS. 10 through 14, the links disposed laterally from the center of link matrix 115 may be pushed inwardly in order to create a three-dimensional shape for tongue portion 112, as illustrated in FIG. 1. For purposes of clarity, the following discussion includes references to top portion 1202 of link matrix 115, bottom portion 1002 of link matrix 115 and intermediate portion 1106, which is disposed between top portion 1202 and bottom portion 1002.

Figure 10:
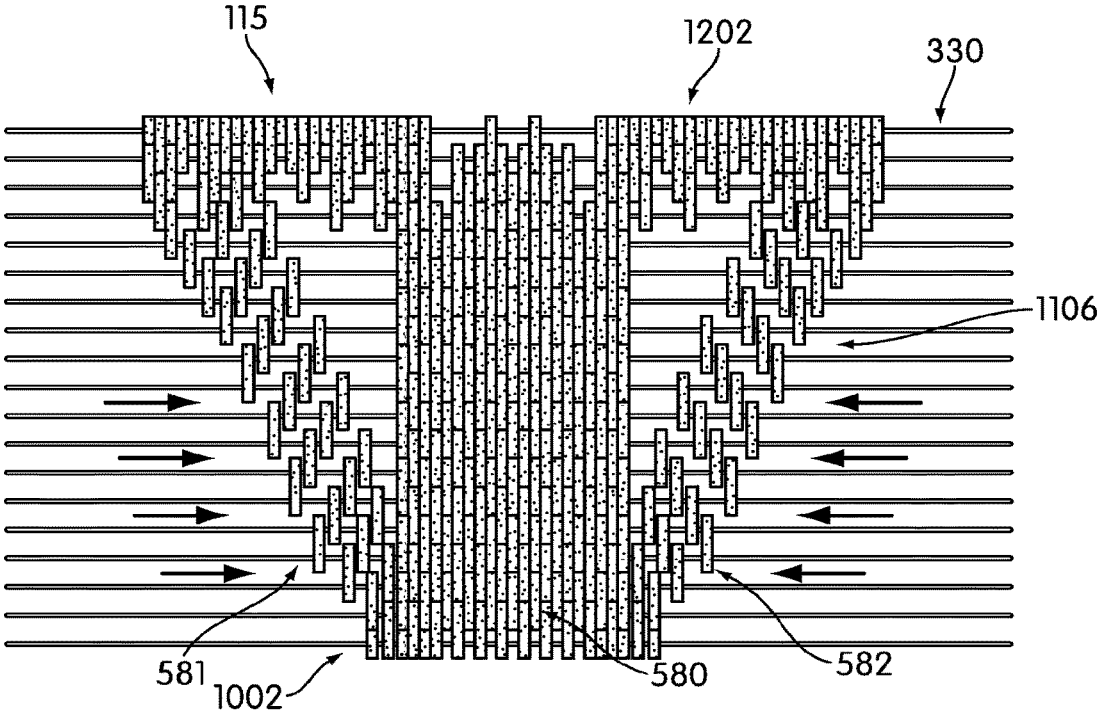
FIG. 10 is a schematic view of an embodiment of inward movement of links to create a link matrix with a three-dimensional shape.
Figure 11:
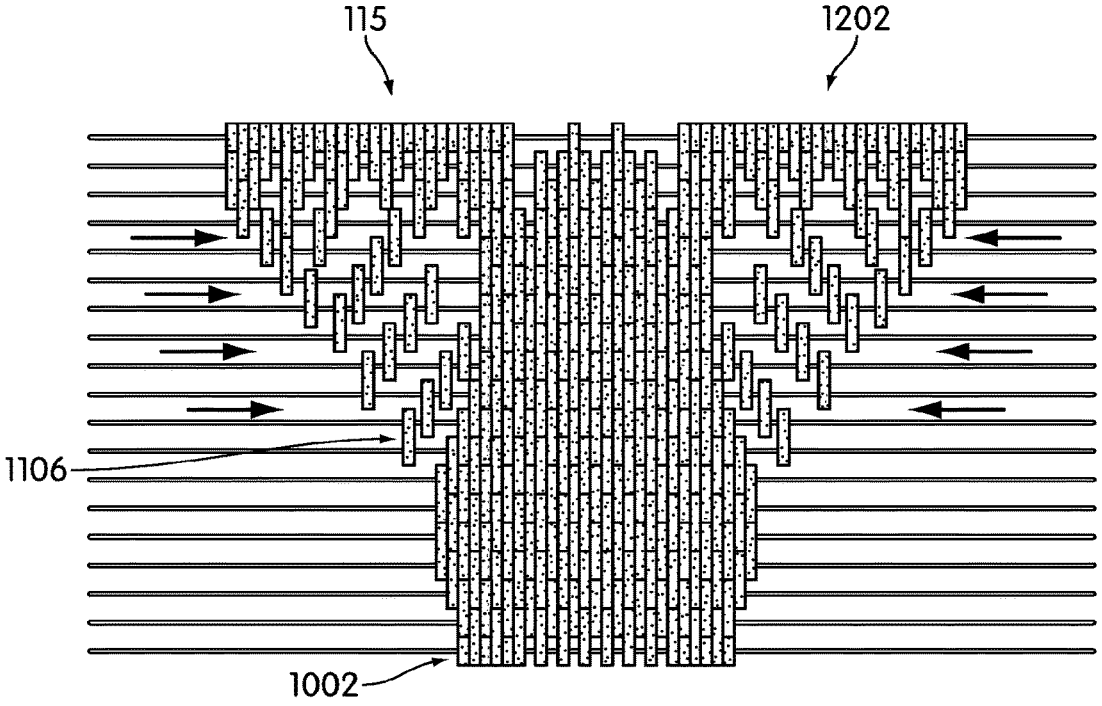
FIG. 11 is a schematic view of an embodiment of inward movement of links to create a link matrix with a three-dimensional shape.

Initially, links disposed on rows within bottom portion 1002 may be pushed inwardly on thread set 330, as seen in FIG. 10. In other words, the links disposed on the lower ends of first lateral portion 581 and second lateral portion 582 may be pushed towards central portion 580. Next, links disposed in intermediate portion 1106 of link matrix 115 may be pushed inwardly, as seen in FIG. 11. In some cases, the substantially even spacing of first wide gap 571 and second wide gap 572, as illustrated in FIG. 9, within bottom portion 1002 and intermediate portion 1106 may facilitate even distributions of links in the lateral direction. This arrangement provides a generally flat shape for intermediate portion 1106 and bottom portion 1002.

Figure 12:
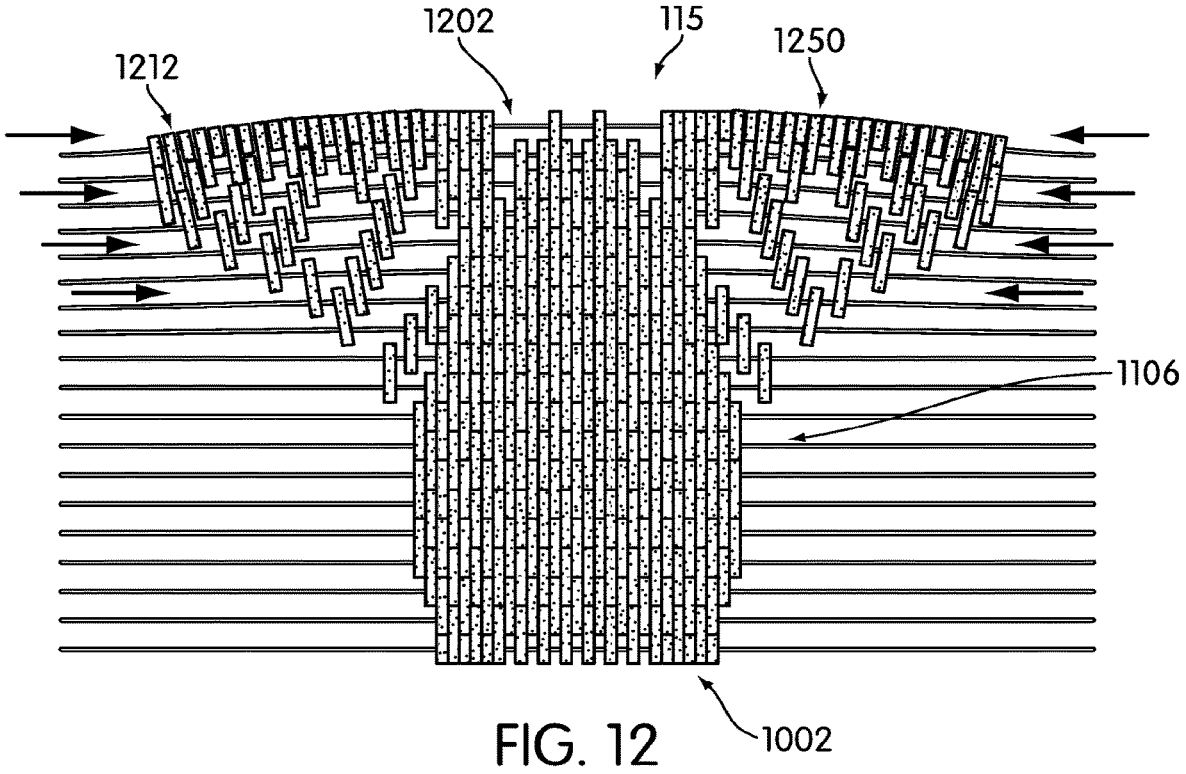
FIG. 12 is a schematic view of inward movement of links to create a link matrix with a three-dimensional shape.
Figure 13:
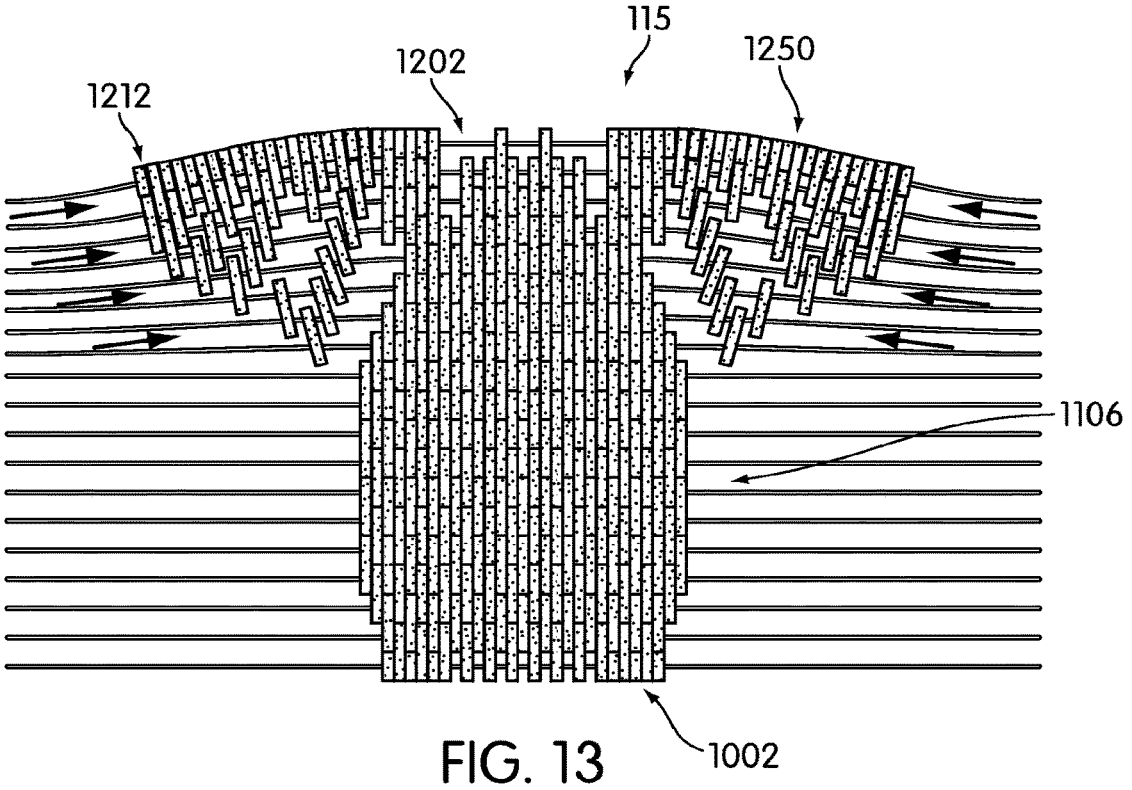
FIG. 13 is a schematic view of inward movement of links to create a link matrix with a three-dimensional shape.

Referring to FIGS. 12 and 13, links disposed within top portion 1202 may be pushed inwardly. In order to accommodate the difference in the number of links in adjacent rows of top portion 1202, top portion 1202 may also be bent slightly as the links are pushed inwards. In some cases, lateral end portions 1212 of top portion 1202 may be bent downwards slightly, in a direction towards bottom portion 1002 of link matrix 115. In some cases, upper periphery 1250 of link matrix 115 may have a slightly curved shape as lateral end portions 1212 are bent downwards.

Figure 14:
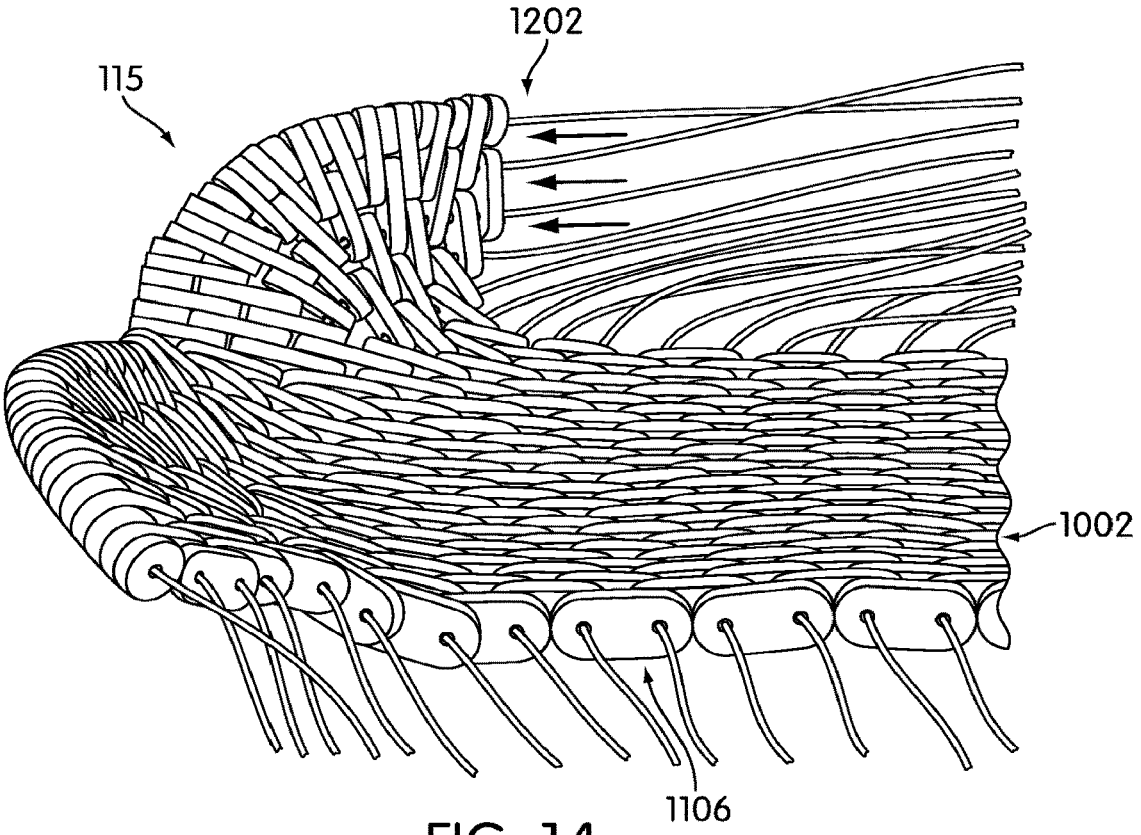
FIG. 14 of inward movement of links to create a link matrix with a three-dimensional shape.

Referring to FIG. 14, as the links in top portion 1202 are pushed further together towards the center of link matrix 115, top portion 1202 may begin to curve in a vertical direction. The term "vertical direction" as used throughout this detailed description and in the claims refers to a direction that is perpendicular to the longitudinal and lateral directions associated with link matrix 115. In other words, link matrix 115 transitions from being substantially two-dimensional to being substantially three-dimensional. In contrast, intermediate portion 1106 and bottom portion 1002 may remain substantially flat.

Figure 15:
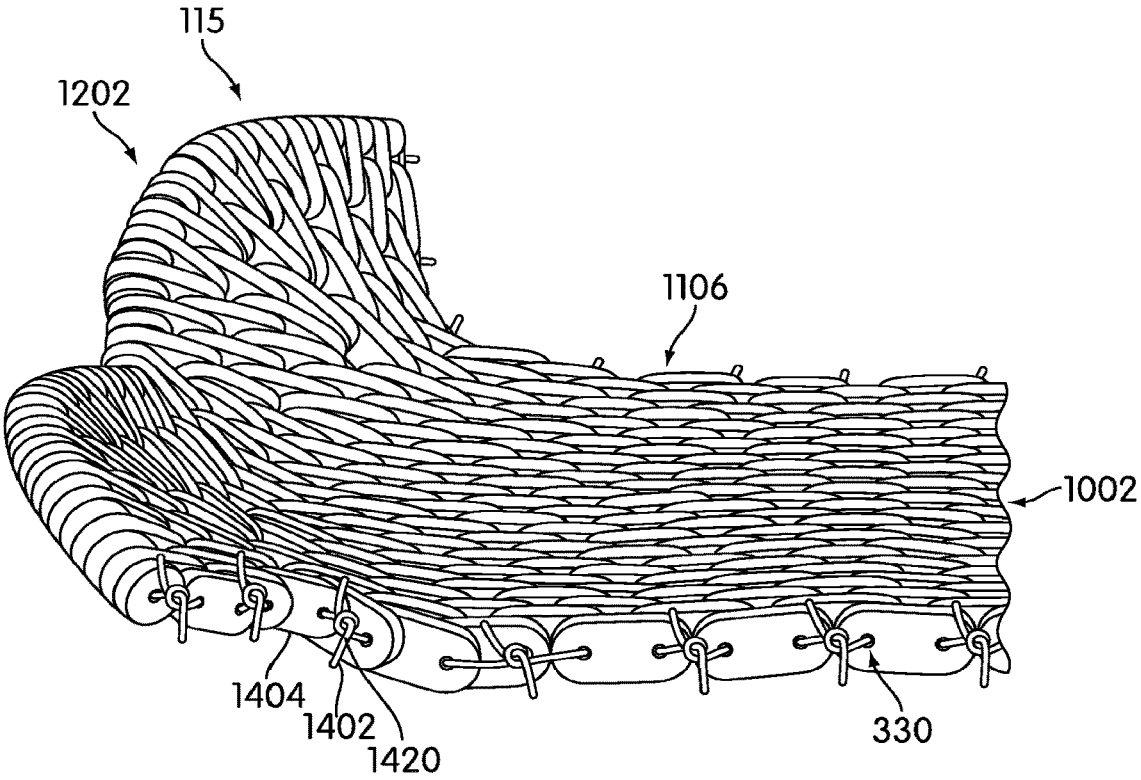
FIG. 15 is a schematic view of an embodiment of an assembled link matrix with thread ends of a thread set tied into knots.

Referring to FIG. 15, once link matrix 115 has been assembled, thread ends 1402 of thread set 330 can be tied off. For example, in this embodiment, thread ends 1402 have been tied into knots 1420. In particular, adjacent thread ends 1402 are tied together in a knot. In some cases, extra threading material that extends outwards from peripheral edges 1404 of link matrix 115 may be cut.

For purposes of illustration, the method discussed in the current embodiment has been applied to making a link matrix that is used as a tongue portion in an article of footwear. However, it should be understood that this method can be used to create other link matrices that can be used in other articles. Furthermore, this method of assembling a link matrix using a link pattern can be used to assemble more complicated three-dimensional link matrices, such as those used for an upper of an article of footwear.

Figure 16:
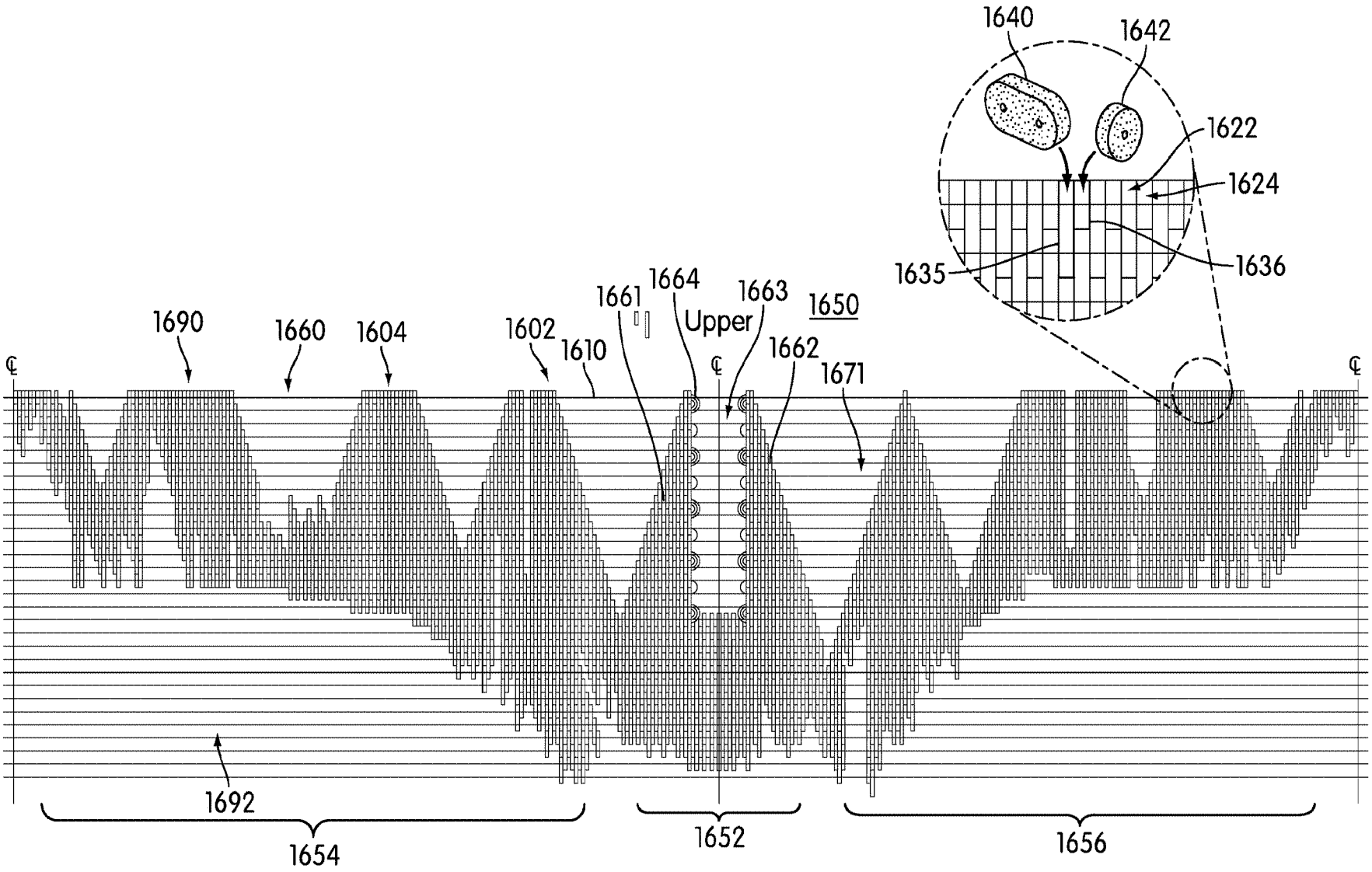
FIG. 16 is a schematic view of an embodiment of a link pattern that may be used to assemble an upper for a linked article.

FIG. 16 illustrates an embodiment of a link pattern that may be used to assemble an upper for a linked article. In this exemplary embodiment, upper link pattern 1602 comprises plurality of link indicia 1604 arranged on sheet 1650. In particular, plurality of link indicia 1604 are arranged in rows corresponding to thread indicia 1610.

In different embodiments, upper link pattern 1602 can include different numbers of rows and thread indicia. In one embodiment, upper link pattern 1602 may include a single row and a single thread indicia. In another embodiment, upper link pattern 1602 may include twenty rows and twenty thread indicia. In an exemplary embodiment, upper link pattern 1602 may include thirty rows and third thread indicia.

Referring to FIG. 16, plurality of link indicia 1604 may comprise first link indicia set 1622 and second link indicia set 1624. In some embodiments, first link indicia set 1622 may comprise link indicia having a rectangular shape. Likewise, second link indicia set 1624 may comprise link indicia having a rectangular shape. Furthermore, the link indicia of first link indicia set 1622 may have a longer length than the link indicia of second link indicia set 1624. With this arrangement, first link indicia set 1622 and second link indicia set 1624 can be used to indicate the relative locations of different sized links.

In this embodiment, first link indicia set 1622 may comprise link indicia that are associated with double links. In this exemplary embodiment, first link indicia set 1622 may span two rows of upper link pattern 1602. For example, in this embodiment, upper link indicia 1635 of first link indicia set 1622 is used to indicate the location of double link 1640.

Second link indicia set 1624 may comprise link indicia that are associated with single links. In this exemplary embodiment, second link indicia set 1624 may span a single row of upper link pattern 1602. For example, in this embodiment, upper link indicia 1636 of second link indicia set 1624 is used to indicate the location of single link 1642.

Upper link pattern 1602 may include a plurality of link portions. For example, upper link pattern 1602 may include central portion 1652. In some cases, central portion 1652 may correspond to a vamp portion of an upper. Central portion 1652 can include first portion 1661 and second portion 1662 that are separated by central gap 1663. In some cases, central gap 1663 may be a lacing gap that is configured to receive one or more laces. In some cases, first portion 1661 and second portion 1662 may include provisions for receiving laces. In this exemplary embodiment, lace loop indicia 1664 are also provided in upper link pattern 1602 to indicate the attachment location of lacing loops for an upper.

Upper link pattern 1602 may also include first lateral portion 1654 and second lateral portion 1656 that are disposed on opposing lateral sides of central gap 1663. First lateral portion 1654 and second lateral portion 1656 can include provisions for receiving laces.

In embodiments where a link matrix may be configured with a high degree of curvature, a corresponding link pattern can be configured with a plurality of gaps. As illustrated in the previous embodiment, gaps in a link pattern can be used to create local curvature in regions of a link matrix associated with the gaps. In particular, gaps with varying widths can be used to control the degree of local curvature on a portion of a link matrix.

Upper link pattern 1602 can include a plurality of gaps. As previously discussed, gaps in a link pattern can have varying shapes and/or sizes. In this exemplary embodiment, upper link pattern 1602 comprises plurality of gaps 1660. Plurality of gaps 1660 may include triangular shaped gaps, rectangular shaped gaps, irregular shaped gaps and irregular shaped gaps. Furthermore, plurality of gaps 1660 may comprise gaps of differing widths and lengths.

In one embodiment, plurality of gaps 1660 may comprise first gap 1671. In some cases, first gap 1671 may have a substantially triangular shape. Furthermore, first gap 1671 has a large width towards top portion 1690 of upper link pattern 1602. Also, first gap 1671 has a width that tapers towards bottom portion 1692 of upper link pattern 1602. With this arrangement, first gap 1671 may provide a high degree of curvature in a link matrix assembled using upper link pattern 1602.

Although only first gap 1671 is discussed here, it should be understood that the remaining gaps of plurality of gaps 1660 may further facilitate curvature in different portions of an assembled link matrix. In particular, the curvature may vary according to the size and shape of the various gaps. In one embodiment, plurality of gaps 1660 may be configured to provide the appropriate amount of curvature to form a link matrix into an upper.

In order to make an upper using upper link pattern 1602, a plurality of threads may be associated with sheet 1650. Next, a plurality of links may be threaded with the plurality of threads according to plurality of link indicia 1604 of upper link pattern 1602. Once the entire link matrix has been assembled, the link matrix may be removed from sheet 1650. At this point, the links may be moved along the plurality of threads in order to create a three-dimensional shape for the upper. Finally, once the upper has achieved the correct shape, the excess threading material may be removed and tied off into knots.

Figure 17:
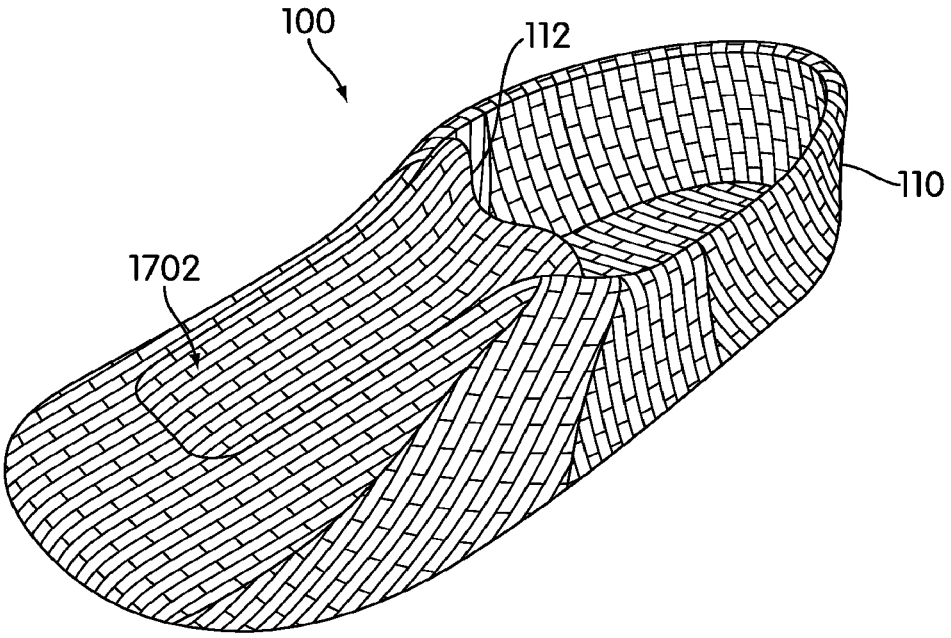
FIG. 17 is a schematic view of an embodiment of an article including two link matrices.

Referring to FIG. 17, upper portion 110 of article 100 can be associated with tongue portion 112 to form an article made substantially entirely of links. In some embodiments, upper portion 110 and tongue portion 112 may be assembled using a single link matrix. This arrangement may allow tongue portion 112 to be integrally formed with upper portion 110. In other embodiments, upper portion 110 and tongue portion 112 may be assembled from more than one link matrix. In one embodiment, upper portion 110 may be assembled using a first link matrix and tongue portion 112 may be assembled using a second link matrix.

In embodiments where upper portion 110 and tongue portion 112 are first assembled as distinct link matrices, upper portion 110 and tongue portion 112 may be joined together in any known manner. In one embodiment, one or more threads from tongue portion 112 may be threaded through one or more links associated with upper portion 110. Likewise, in some cases, one or more threads from upper portion 110 may be threaded through one or more links associated with tongue portion 112. With this arrangement, tongue portion 112 can be joined with upper portion 110 without the need for additional fasteners.

Although the current embodiment includes a linked article with two link matrices, in other embodiments an article could include any number of distinct link matrices. Furthermore, in some cases, link matrices may be used in combination with traditional upper materials. For example, in an alternative embodiment an upper could be made of a link matrix, while a tongue portion is made of a synthetic leather. In another alternative embodiment, a vamp portion could be made of a link matrix while side panels of an upper are made of a fabric material.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear comprising:

a plurality of threads arranged side-by-side to form a plurality of rows, the plurality of threads including a first thread and second thread;

a first double-hole bead including a first hole and a second hole, the first thread being slidably threaded through the first hole and the second thread being slidably threaded through the second hole;

a single-hole bead that is directly adjacent to the first double-hole bead and that includes a third hole, the first thread being slidably threaded through the third hole; and a second double-hole bead that is positioned directly adjacent to the single-hole bead and that includes a fourth hole and a fifth hole, the first thread being slidably threaded through the fourth hole and the second thread being slidably threaded the fifth hole, wherein no other bead that is threaded onto the second thread separates the first double-hole bead and the second double-hole bead.

2. The article of footwear of claim 1, wherein the first thread includes first-thread terminating stop elements at each end of the first thread and includes a first length between the first-thread terminating stop elements, and wherein the second thread includes second-thread terminating stop elements at each end of the second thread and includes a second length between the second-thread terminating stop elements.

3. The article of claim 2, wherein the first-thread terminating stop elements and the second-thread terminating stop elements include knots tied in the first thread and the second thread.

4. The article of claim 3, wherein the first and second threads are tied with one another into a first knot at a first terminating end and are tied with one another into a second knot at a second terminating end.

5. The article of claim 4, wherein the first length is longer than the second length.

6. The article of claim 5, wherein the first double-hole bead and the second double-hole bead are biased closer towards one another along the second thread than on the first thread.

7. An article of footwear comprising:

a plurality of threads arranged side-by-side to form a plurality of rows, the plurality of threads including a first thread, a second thread, and a third thread;

a first set of double-hole beads and single-hole beads, wherein each double-hole bead in the first set includes a respective first hole receiving the first thread and a respective second hole receiving the second thread, wherein each single-hole bead in the first set includes a respective third hole receiving the first thread, wherein the double-hole beads in the first set alternate with the single-hole beads in the first set, and wherein along the second thread a respective gap is positioned between each of the double-hole beads; and a second set of double-hole beads each of which includes a respective fourth hole receiving the second thread and a respective fifth hole receiving the third thread, wherein a double-hole bead of the second set of double-hole beads is positioned in every other respective gap.

8. The article of footwear of claim 7, wherein the first thread includes a first length, the second thread includes a second length, and the third thread includes a third length, and wherein the first length is longer than the second length and the second length is longer than the third length.

9. The article of footwear of claim 8, wherein beads arranged on the second thread and on the third thread angle inwards towards a central portion of a matrix formed by the plurality of threads, the first set of double-hole beads and single-hole beads, and the second set of double-hole beads.

10. The article of footwear of claim 9, wherein the third thread is positioned in a different plane than the first and second threads.

11. An article of footwear comprising:

a bead matrix comprised of a plurality of threads that form rows in the bead matrix and a plurality of beads that threadably receive the plurality of threads, the bead matrix comprising:

a first thread having a first set of beads threadably received thereon, the first set of beads including a plurality of double-hole beads that are also coupled to a second thread, the first thread including terminating free ends, and the second thread having a second set of beads threadably received thereon, wherein the second thread is shorter than the first thread and includes terminating free ends, at least one terminating free end of the second thread being coupled to at least one terminating free end of the first thread, wherein the second set of beads includes fewer beads than the first set of beads, and wherein the second set of beads includes another plurality of double-hole beads that are also coupled to a third thread.

12. The article of footwear of claim 11 further comprising: the third thread having a third set of beads threadably received thereon, wherein the third thread is shorter than the second thread and the third set of beads includes fewer beads than the second set of beads, and wherein the bead matrix includes a concave configuration in which the third thread is not arranged in a plane in which both the first thread and the second thread are positioned.

13. The article of footwear of claim 12, wherein the matrix comprises an upper of the article of footwear.

14. The article of footwear of claim 13, wherein the matrix comprises a tongue of the article of footwear.

15. The article of footwear of claim 11, wherein the at least one terminating free end of the second thread is bound to the at least one terminating free end of the first thread.

16. The article of footwear of claim 11, wherein the at least one terminating free end of the second thread is tied to the at least one terminating free end of the first thread.

17. The article of footwear of claim 11, wherein the at least one terminating free end of the second thread is releasably coupled to the at least one terminating free end of the first thread.

18. The article of footwear of claim 11, wherein the terminating free ends of the second thread are releasably coupled to the terminating free ends of the first thread.

* * * * *